US006458052B1

(12) United States Patent
Pitsenberger et al.

(10) Patent No.: US 6,458,052 B1
(45) Date of Patent: Oct. 1, 2002

(54) GAME BALL SIMULATING A SEWN COVER

(75) Inventors: Dan S. Pitsenberger; Danny W. Maxey, both of Tullahoma, TN (US)

(73) Assignee: Worth, Inc., Tullahoma, TN (US)

( * ) Notice: Subject to any disclaimer, the term of this patent is extended or adjusted under 35 U.S.C. 154(b) by 0 days.

(21) Appl. No.: 09/785,645

(22) Filed: Feb. 16, 2001

(51) Int. Cl.[7] ..... A63B 37/12
(52) U.S. Cl. ..... 473/598; 473/600
(58) Field of Search ..... 473/603, 597, 473/598, 600, 601, 602

(56) References Cited

U.S. PATENT DOCUMENTS

| | | | | | |
|---|---|---|---|---|---|
| RE21,063 | E | * | 4/1939 | Voit | 473/602 |
| 2,684,106 | A | * | 7/1954 | Fegan | 473/598 |
| 4,498,667 | A | * | 2/1985 | Tomar | 473/600 |
| 4,572,507 | A | | 2/1986 | Hubbert et al. | |
| 4,660,830 | A | * | 4/1987 | Tomar | 473/301 |
| 4,725,058 | A | | 2/1988 | Molitor | |
| 4,822,041 | A | | 4/1989 | Molitor | |
| 4,840,378 | A | | 6/1989 | Molitor | |
| 4,861,028 | A | | 8/1989 | Williams | |
| 4,880,233 | A | * | 11/1989 | Song | 473/598 |
| 5,123,659 | A | | 6/1992 | Williams | |
| 5,647,590 | A | | 7/1997 | Walker et al. | |
| 5,664,774 | A | * | 9/1997 | Walker et al. | 473/600 |

* cited by examiner

*Primary Examiner*—Steven Wong
(74) *Attorney, Agent, or Firm*—Waddey & Patterson; Edward D. Lanquist, Jr.

(57) ABSTRACT

A game ball comprising a spherical core and two-piece cover. The cover includes two figure eight-shaped pieces adhesively attached to the core. Furthermore, each figure eight-shaped piece may be separately stitched around the edges, given the appearance of a stitched ball once the cover pieces are in place. Preferably, the stitching pattern is a traditional herringbone pattern. Also provided is a process for making a game ball. This process comprises providing a spherical core and cover material comprising two stitched figure eight-shaped pieces. The stitched figure eight-shaped pieces are placed around the core using an adhesive.

27 Claims, 2 Drawing Sheets

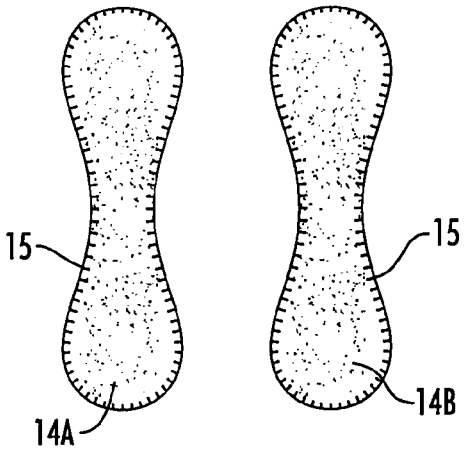
FIG. 1
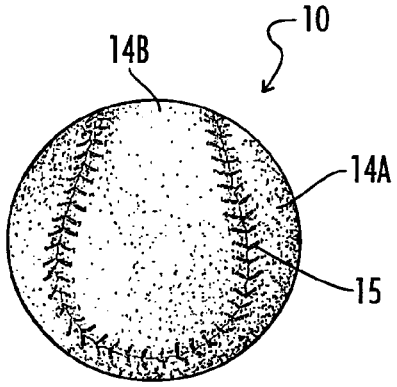
FIG. 2
FIG. 3
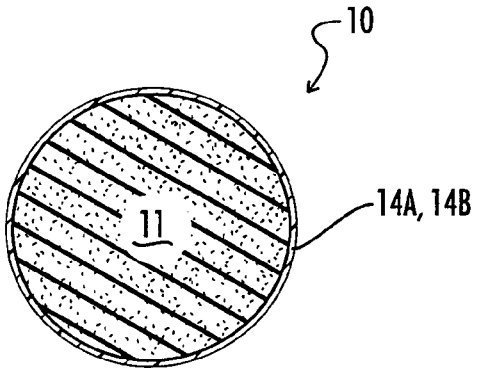
FIG. 4
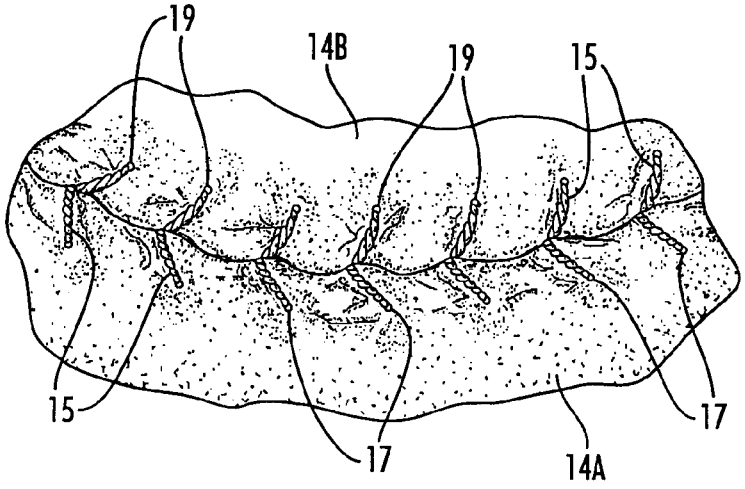

GAME BALL SIMULATING A SEWN COVER

FIELD OF THE INVENTION

This invention relates to a game ball having a cover that has the appearance of traditionally sewn ball, but is manufactured by a process that does not require hand sewing the pieces of the cover together.

BACKGROUND OF THE INVENTION

Traditional baseballs and softballs are generally stitched by hand. This process usually involves placing a core made of varying materials in a jaw or locking device, and the synthetic or leather covers are then hand stitched to form the traditional figure eight shape of softballs and baseballs with the traditional herringbone stitching pattern.

Over the years there have been processes developed that manufacture balls that are one piece, or molded-type baseballs or softballs that have a simulated stitch pattern. Lisco, Inc., a division of Spalding, has developed a molded covered ball having simulated stitch patterns. However, most molded covered balls have had limited success, as the industry still prefers the traditional leather or high quality synthetic leather balls that are hand stitched.

Very generally, the typical process of hand-sewing a ball is to place the ball in a jaw or fixture. Two figure 8 shaped covers are placed on the ball and attached with nails or an adhesive on the back of the cover to hold the ball in place while stitching the threads. The cover is hand stitched and the tacks are removed as the stitched continue around the circumference of the ball. The cover is also adjusted and relocated as the stitching process continues to provide the symmetrical look of the seams. Upon completion of the stitching, the thread is "hidden" underneath the cover, which is typically done by pulling the excess thread underneath the stitches. This is preferred so that the thread is not seen or felt under the cover portion of the ball where there are no stitches.

The traditional method is an labor-intensive process, requiring most balls to be stitched in countries with lower labor rates in order to control the final cost of the balls.

In the past, there have been attempts to automate the process. However, to date none of them have been successfully commercially developed. Additionally, there have been attempts to produce a ball with different core and cover materials, none of which disclosing or suggesting the objects of the present invention.

U.S. Pat. No. 4,822,041 to Moliter discloses a molded solid softball having simulated stitching including protrusions and indentations on the outer surface integral with the body of the ball and further having simulated holes adjacent to the outer edges of the stitching. The cover of the ball includes simulated stitches and stitch holes similar to that of a leathercovered and stitched ball.

U.S. Pat. No. 5,647,590 to Walker, et al. discloses a game ball having a molded polyvinyl chloride plastisol cover formed around the core. The molding operation may employ simulated stitching and stitch holes adjacent to the outer edges of the stimulated stitching.

U.S. Pat. No. 4,840,378 to Moliter discloses a softball with a cellular polymeric material core and a vinyl resin cover. The ball comprises simulated stitching and stitch holes which are molded as part of the cover.

U.S. Pat. No. 4,861,028 to William discloses a softball having a hollow spherical core in a leather cover which surrounds the core. The core is formed from two dumbbell-shaped pieces which are stitched or sewn together along the seams.

U.S. Pat. No. 5,123,659 to William discloses a game ball with a hollow spherical core and a cover which surrounds the core, wherein two dumbbell-shaped pieces are stitched or sewn together along seams. The cover disclosed in this patent may be formed from leather, vinyl, or similar material which can be used to simulate the look and feel of leather covers.

U.S. Pat. No. 4,840,378 to Molitor discloses a softball having a cover and a core and simulated stitching and stitch holes molded as part of the cover.

U.S. Pat. No. 4,725,058 to Molitor discloses a softball having a cover and a core wherein the cover comprises simulated stitching and stitch holes which are molded as part of the cover.

U.S. Pat. No. 4,572,057 to Hubdert, et al., discloses a game ball comprising a core surrounded by a yarn winding which is saturated with a latex based adhesive. This core is then covered with a two piece stitched cover.

SUMMARY OF THE INVENTION

An object of the present invention is to provide a game ball comprising a spherical core and a two-piece cover. The cover includes two 2 figure 8-shaped pieces adhesively attached to the core. Furthermore, the each Figure 8-shaped piece may be separately stitched around its edges, giving the appearance of a stitched ball once the cover pieces are in place. Preferably, the stitching pattern is the traditional herringbone pattern.

The game balls of the present invention are typically used for diamond sports. Preferably, the game balls of the present invention are softballs or baseballs. The game ball covers may comprise natural leather or may comprise synthetic leather. If synthetic leather is used, the synthetic leather is preferably a polyvinyl material. Other cover materials such as a Poly Urethane Substrate with woven or non-woven backing may also be used.

In another embodiment of the present invention, the stitching around the edges of the cover pieces is simulated stitching. In such an embodiment, it is still preferred that the simulated stitches are arranged in the traditional herringbone stitching pattern when the cover pieces are places around the ball.

The present invention also provides a process for making a game ball. This process comprises providing a spherical core and cover material comprising two stitched figure 8-shaped pieces. The stitched figure 8-shaped pieces are placed around the core using an adhesive.

The result of the method of the present invention is a ball that has the appearance of a traditionally stitched ball, wherein the covers are interlocked by the stitching. However, the covers of the present invention are pre-stitched around the edges and are in fact applied separately and attached in place. Thus, a ball is created that has the appearance of a hand sewn ball, but can be manufactured with automated equipment to eliminate the had sewing process.

BRIEF DESCRIPTION OF THE DRAWINGS

FIG. 1 is a view of two figure 8 shaped cover pieces suitable for use as the cover.

FIG. 2 is a view of a game ball of the present invention with the cover attached to the core in a manner such that the seams are aligned in he traditional pattern.

FIG. 3 is a view of the cover material of the present invention adhered to acore.

FIG. 4 is a closer view of the seams of a game ball of the present invention. The stitching is in the traditional herringbone pattern.

DETAILED DESCRIPTION OF THE INVENTION

Figure 5:
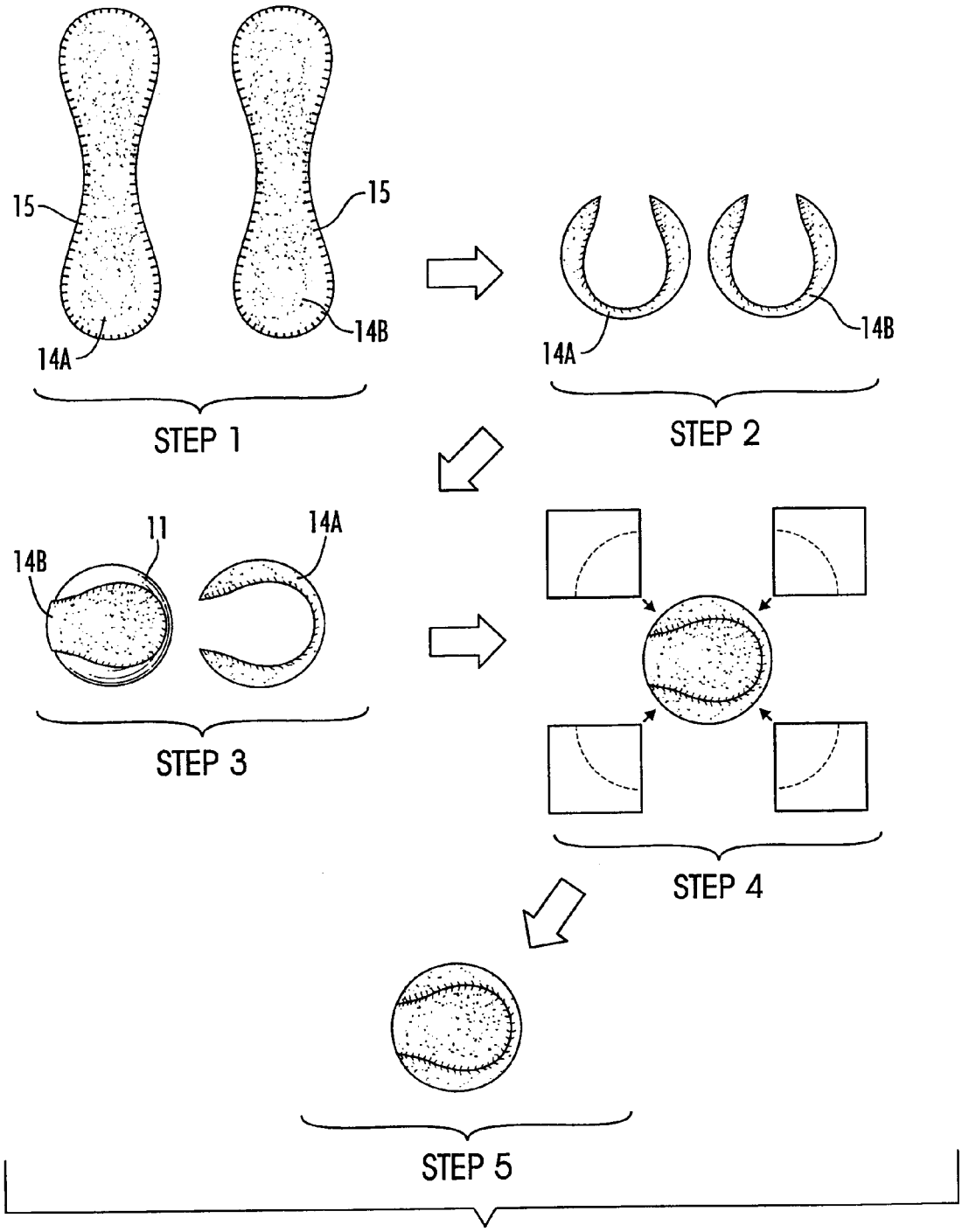
FIG. 5 demonstrates a process of making a game ball of the present invention.

As stated above, an object of the present invention relates to a game ball having a spherical core and two piece cover. The two piece cover includes two figure eight-shaped pieces adhesively attached to the core. These figure eight pieces may be separately stitched around its edges. When the separately stitched figure eight pieces are assembled around the core, the stitch patterns along the seams of the assembled ball appear to be the pattern of a traditionally sewn ball. The stitching on the cover pieces may be simulated stitches or may be cover pieces that have actually been stitched around the edges. The traditional stitch pattern is also known as a herringbone pattern.

The game ball of the present invention is preferably a ball used in diamond sports. More preferably, the game ball is a softball or a baseball.

Regarding the cover, the nature of the cover material is not known to be critical as long as it does not fundamentally interfere with the functions of the present invention. That is, the cover material may be a natural leather or a synthetic material known in the art. If a synthetic cover is used, preferably the synthetic cover is a vinyl resin or polyvinyl material.

As stated above, the cover material is not known to be critical. The cover may typically have a thickness of from 1.3 mm to 1.9 mm; preferably from 1.4 mm to 1.7 mm.

Like the cover material, the core material is not known to be critical, as one of ordinary skill in the art can select the core material based on the desired performance of the ball. For instance, the core material may be a cellular polymeric material such as polyurethane (including polyurethane foams), cork, or a thermoplastic resin. The core may be a one piece core ,a two piece core or wound cores with synthetic yarn or wool yarn.

The core size is typically adjusted to compensate for the thickness of the chosen cover to meet the final diameter as specified by the rules of the game.

The hardness of the ball is critical in terms of achieving the desired performance. For instance, the specific hardness of the ball to achieve the desired performance is within the ordinary skill in the art and can be adjusted with the balls of the present invention accordingly.

The coefficient of restitution (COR) is a measurement of the liveliness of a ball. The COR is important because many organizations or leagues use the COR to determine which balls may be used for league play. For example, specifications for softballs have been issued by two governing organizations, the United Slow-Pitch Softball Association and the Amateur Softball Association. The COR is measured by propelling a ball against a hard surface at 60 miles per hour (88 FPS) and measuring the rebound speed of the ball. COR is expressed in terms of the ratio of the rebound speed to 60 miles per hour.

The game balls of the present invention may have a coefficient of restitution of from 0.40 to 0.57. Most preferably the softballs of the present invention have COR's of from 0.40 to 0.53; preferably from 0.40 to 0.50; and most preferably from 0.44 to 0.47. Most preferably the baseballs of the present invention have COR's of from 0.52 to 0.57; preferably from 0.53 to 0.55; and most preferably from 0.54 to 0.55.

Turning now to the drawings, FIG. 1 shows the two figure eight pieces of the cover which are adhesively attached to the core. The seams 15 are sewn or surged along the edges of the two pieces, 14A and 14B. FIG. 2 shows the completed ball 10 with pieces 14A and 14B attached thereto. As can be seen, the stitches 15 are arranged in a pattern of a traditionally sewn ball.

FIG. 3 shows a cross sectional view of a game ball 10 of the present invention with the pieces of the cover 14A and B attached to the core 11.

FIG. 4 is an enlarged view of a seam where the two cover pieces 14A, 14B are attached to the core. This enlarged view more clearly shows the traditionally stitched patterns. The stitches 15 are arranged in a herringbone pattern. As stated above, the stitches may be sewn into the covers prior to attachment to the core or may be simulated stitches. If simulated stitches are used, simulated stitch holes, 17 and 19 may also be incorporated into the stitch pattern of the ball of the invention.

The game balls of the present invention are made by cutting figure eight shaped pieces of leather, including synthetic leather and the subsequent stitching on the edge of each figure eight shaped piece stitch patterns. Alternatively, the stitch patterns may be molded into the edges of the figure eight shaped pieces if synthetic leather is used. The stitch patterns are mirror images of each other and match when they are placed on the ball so that they appear to be the stitches of a traditionally sewn ball.

The flat stitched covers are then steam pressed around a sphere to mold the covers into a three dimensional spherical ball cover. The next step is to align the two spherical shaped covers onto a core. Preferably, the covers are temporarily fastened around the ball core. The ball core is preferably encapsulated or coated with either a latex adhesive or heat activated adhesive material. Examples of the adhesive material include: Loctite two part adhesives or a HB Fuller Heat Activated glue. A preferred adhesive is Valley Adhesives A-3500, available from Valley Adhesives, Appleton, Wis.

FIG. 5 demonstrates a method of the present invention whereby the cover pieces are attached to the core. In Step 1, the covers, 14*a* and 14*b*, are placed in a fixture. In Step 2, steam or heat is applied to the covers allowing them to take a three dimensional shape that is representative of the final produce. The covers are then aligned in Step 3 and paced on the core in Step 4. The completed ball is removed in Step 5.

All cited patents and publications referred to in this application are herein expressly incorporated by reference.

This invention thus being described, it will be obvious that the same may be varied in many ways. Such variations are not to be regarded as a departure from the spirit and scope of the present invention, and all such modifications as would be obvious to one of ordinary skill in the art are intended to be included within the scope of the following claims.

We claim:

1. A game ball comprising:

a spherical core; and a two-piece cover including two 2 figure 8-shaped pieces adhesively attached to the core, wherein each figure 8-shaped piece is separately stitched around its edges.

2. The game ball of claim 1, wherein said game ball is a softball.

3. The game ball of claim 1, wherein said game ball is a baseball.

4. The game ball of claim 1, wherein the pieces of the cover are aligned to create a stitch pattern along the seams of the two piece cover of the game ball, which pattern appears to be the stitched of a traditionally sewn ball.

5. The game ball of claim 1, wherein the pieces of the cover are aligned to create a stitch pattern of the game ball, which pattern is a herringbone pattern.

6. The game ball of claim 1, wherein the pieces of the cover comprise natural leather.

7. The game ball of claim 1, wherein the pieces of the cover comprise synthetic leather.

8. The game ball of claim 7, wherein the synthetic leather is a polyvinyl material.

9. The game ball of claim 7, wherein the pieces of the cover comprise simulated stitching around their edges.

10. The game ball of claim 1, wherein the cover has a thickness of from 0.04 to 0.06 inches.

11. The game ball of claim 1, wherein the core is coated with an adhesive material.

12. The game ball of claim 11, wherein the adhesive material is a latex adhesive.

13. The game ball of claim 11, wherein the adhesive material is a heat activated adhesive.

14. The game ball of claim 1, wherein the cover is attached to the core by a heated compression mold.

15. The game ball of claim 1, wherein the core comprises polyurethane.

16. The game ball of claim 1, wherein the game ball has a coefficient of restitution at 88 feet per second of from 0.40 to 0.57.

17. A process for making a game ball, comprising:

providing a spherical core;

providing a cover comprising two figure 8-shaped pieces having outside edges;

stitching the outside edges with a thread; placing the stitched figure 8-shaped pieces around the core; and adhesively attaching the figure 8-shaped pieces to the core.

18. The process of claim 17, wherein the game ball is a softball.

19. The process of claim 17, wherein the game ball is a baseball.

20. The process of claim 17, wherein the stitches are arranged around the core in a herringbone pattern.

21. The process of claim 17, wherein the stitches on each figure 8-shaped piece mirror one another and match or have an interlocked appearance when placed on the core so that the stitched pattern of the game ball is that of a traditionally sewn ball.

22. The process of claim 17, further comprising:

steam pressing the figure 8-shaped pieces around a sphere to mold the pieces into three dimensional spherical ball covers.

23. The process of claim 17, wherein the core is coated with an adhesive material prior to the cover pieces being placed thereon.

24. The process of claim 23, wherein the adhesive material is a latex adhesive.

25. The process of claim 23, wherein the adhesive material is heat activated.

26. The process of claim 25, further comprising activating said heat activated adhesive to affix the cover pieces to the core.

27. The process of claim 26, wherein said activating step comprises inserting the ball into a heated compression chamber applying pressure or heat to the ball.

* * * * *